United States Patent [19]

Fuss et al.

[11] Patent Number: 4,787,619

[45] Date of Patent: Nov. 29, 1988

[54] SHEET FEED BENCH WITH BLOWER JETS AND A METHOD OF REMOVING SHEETS FROM A STACK

[75] Inventors: Manfred Fuss, St. Georgen; Joachim Kurtz, Schiltach, both of Fed. Rep. of Germany

[73] Assignee: Mathias Bäuerle GmbH, Fed. Rep. of Germany

[21] Appl. No.: 43,929

[22] Filed: Apr. 29, 1987

[30] Foreign Application Priority Data

Apr. 30, 1986 [DE] Fed. Rep. of Germany ..... 3614623

[51] Int. Cl.[4] ..... B65H 3/14

[52] U.S. Cl. ..... 271/98; 271/105; 271/35; 271/134; 271/166; 271/171; 414/125; 414/129; 414/130

[58] Field of Search ..... 271/94, 97, 98, 99, 271/105, 35, 112, 131–134, 144, 165, 166, 171, 5, 11, 102; 414/116, 125, 127, 129, 130

[56] References Cited

U.S. PATENT DOCUMENTS

| | | | |
|---|---|---|---|
| 2,806,696 | 9/1957 | Bishop | 271/134 X |
| 3,099,442 | 7/1963 | Wendricks et al. | 271/97 |
| 3,253,825 | 5/1966 | Buchwald | 271/97 |
| 3,934,869 | 1/1976 | Strobel, Jr. | 271/35 |
| 4,014,537 | 3/1977 | Stange | 271/35 X |

FOREIGN PATENT DOCUMENTS

| | | | |
|---|---|---|---|
| 19294 | 10/1956 | Fed. Rep. of Germany | 271/94 |
| 2135976 | 9/1984 | United Kingdom | 271/105 |

*Primary Examiner*—Joseph J. Rolla
*Assistant Examiner*—David H. Bollinger
*Attorney, Agent, or Firm*—McGlew and Tuttle

[57] ABSTRACT

In a sheet feed bench with two parallel sheet feed rails that are adjustable relative to one another and with each having blowing jets on their surfaces facing one another directly above the level of the bench, connected to a common source of compressed air, the sheet feed rails resting on the bench surface are provided with groove-like or notch-like enlargements at the level of the blowing jets. Each of these extend over the entire length of the sheet feeder rails. These enlargements make it possible to position the inner surfaces of the sheet feeder rails so closely and tightly against the longitudinal edges of the stack of sheets that only small amounts of compressed air can escape upward. The formation of an air cushion is improved by this in such a way that the stack height can be more than double without adversely affecting the single-sheet separation.

13 Claims, 2 Drawing Sheets

Fig.1
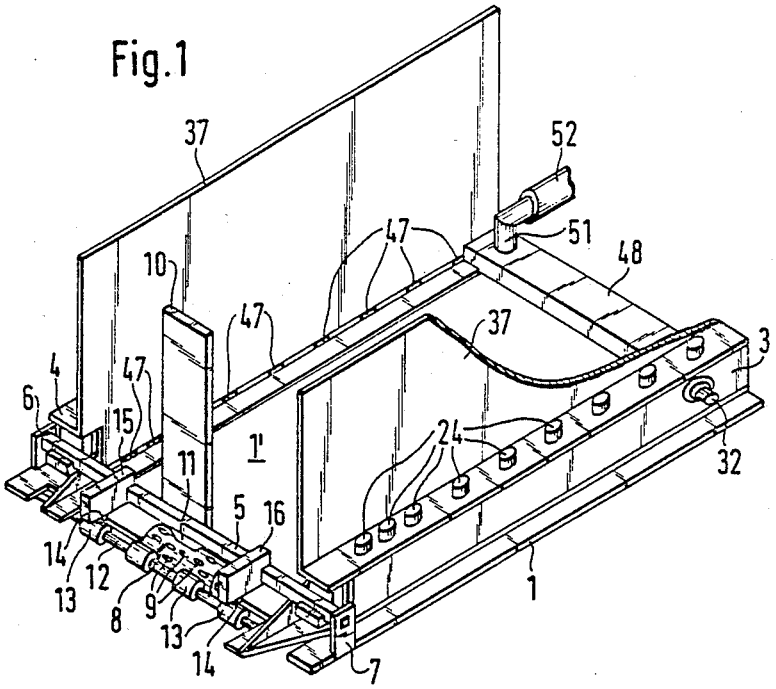
Fig.7
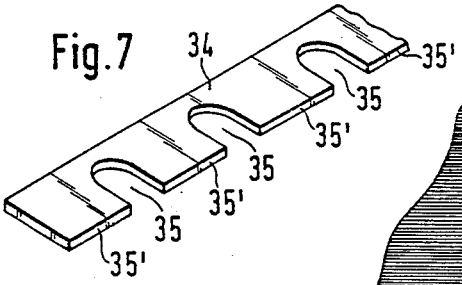
Fig.8
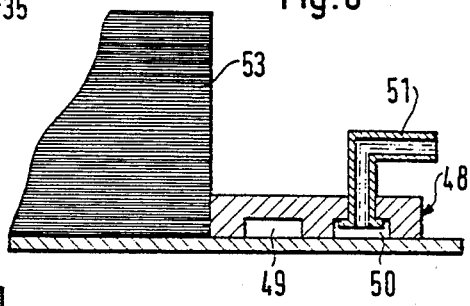
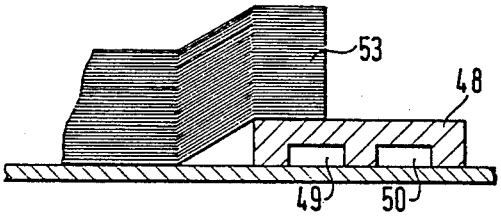
Fig.9

SHEET FEED BENCH WITH BLOWER JETS AND A METHOD OF REMOVING SHEETS FROM A STACK

BACKGROUND OF THE INVENTION

1. Field of the Invention

This invention relates, in general, to sheet feeding devices and, in particular, to a new and useful sheet feed bench and to a method of feeding sheets off a stack thereof.

This invention concerns a sheet feed bench with two parallel sheet feed rails adjustable relative to one another, each of which has several blower jets directly above the level of the bench on their sides facing one another, which are connected or can be connected to a common source of compressed air, and with a single-sheet separator by which the bottom sheet is taken from a stack of sheets that can be refilled from the top.

The single-sheet separators of such sheet benches generally consist of a suction roll that has a number of radial suction holes and is provided with a sector-like vacuum chamber to which a suction fan is connected. Means of transport consisting of rolls or rollers, driven synchronously with the suction roll, are usually placed behind the suction roll and parallel to its axis, to receive the separated sheets and to transport them further. Such sheet feed benches are used, for example, to supply individual sheets from a stack of identical paper sheets at definite, preselectable time intervals, to packaging machines, printers, labelling machines, or the like. Compressed air is blown by the blower jets located in the sheet feed rails from both sides between the bottom sheets of a stack of sheets which results in the formation of at least a thin cushion of air between the individual sheets and thereby facilitates the singling of the sheets and makes it more reliable The front end of the bottom sheet is drawn in by suction by means of the suction roll, and is fed through a stationary stopper edge adjustable in height for different thicknesses of a vertical stopper placed above the suction roll, and is transported to the means of transport located beyond it, which then takes over the further transport of the separated sheet.

The formation of the air cushion between the bottom sheets of the stack of sheets is necessary to relieve the bottom sheet of the weight of the stack. Consequently, the size or weight of a stack that can be stored depends on the carrying capacity of the air cushion and on the nature of the formation of the air cushion in the area of the bottom sheet.

It has already been attempted to improve the quality of formation of the air cushion by increasing the blowing power, i.e., by increasing the supply of compressed air. However, it was found that this step alone cannot produce a significant improvement of the formation of the air cushion, because too much compressed air can escape from the edges of the stack of sheets, which is lost for the formation of the air cushion.

SUMMARY OF THE INVENTION

The invention provides a sheet feed bench including the formation of an air cushion by means as simple as possible, in such a way that as little blown air as possible can escape from the edge areas of the stack of sheets resting on the sheet feed bench. Thus, as large a fraction as possible of the compressed air flowing out of the blower jets, in the area of the bottom sheet of the stack, contributes to the formation of the air cushion so that the air cushion formed is able to support larger stacks of sheets.

Pursuant to the invention, sheet feed rails resting at least approximately air-tight on the surface of the bench are provided in each case with a groove-like or notch-like enlargement on their inner wall surfaces facing one another at the level of the blower jets, each of which extends approximately over the entire length of feed.

Because of the presence of the groove-like or notch-like enlargements in the area of the blower jets, it is possible to position the inner surfaces of the sheet feed rails so closely and tightly against the long sides of the stack of sheets that only very small amounts of compressed air can escape upward. The formation of the air cushion is so improved by this and with the same supply of compressed air, that the height of the stack can be more than doubled without impairing the function of the single-sheet separator or the withdrawal of the bottom sheet. The tight positioning of the two sheet feed rails on the surface of the bench also contributes substantially to reducing the loss of compressed air and thus to improving the formation of the air cushion.

Accordingly, it is an object of the invention to provide a sheet feed bench which comprises a horizontal bench plate with first and second parallel sheet feed rails on the bench plate with at least one or both of them being adjustably movable toward and away from each other and which includes a plurality of blower jets on each rail located directly above the bench plate level on the sides of the rails which face each other and wherein the plate is supplied with a stack of sheets which may be filled from the top and a single sheet separator is located adjacent the bench for removing the lowermost sheets from the stack, the rails resting air-tight on the surface of the bench plate, each having a groove defining respective enlargements along the surface of the rails which face one another at the level of blower jets in the rails which are directed toward the sheet stacks.

A further object of the invention is to provide a method of handling sheet stacks using a horizontal bench plate on which the sheets are stacked from the top and which includes a rail on each side of the stacks which is movable inwardly and outwardly in respect to the stack and which comprises removing the lowermost sheets in the stack while directing a fluid flow inwardly against the stack from the rail members at the level of enlargements which are made along each rail member in a recess of the rail members.

A further object of the invention is to provide a sheet feed bench which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWING

In the Drawings:

FIG. 1 is a perspective elevational view of a feed bench constructed in accordance with the invention;

FIG. 7 is a perspective view of a sealing strip as a separate part;

FIG. 8 is a view of a sealing strip in cross section with connecting ports;

FIG. 9 is a view of the sealing strip in cross section with a different arrangement relative to the rear edge of the stack of sheets.

GENERAL DESCRIPTION OF THE PREFERRED EMBODIMENTS

Figure 2:
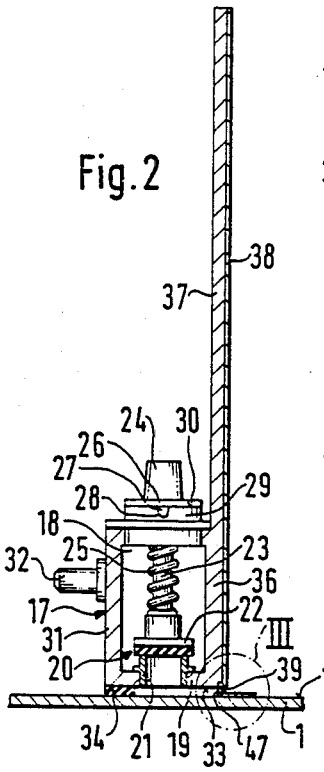
FIG. 2 is a vertical section through a sheet feed rail of the feed bench of FIG. 1.

Referring to the drawings, in particular, the invention embodied therein comprises a sheet feed bench which includes a horizontal bench plate 1 on which the stack of sheets 53 is placed for separating the sheets from the bottom of the stack and for replenishing the stack from the top. In accordance with the invention, two parallel sheet feed rails 3 and 4 are mounted directly on the horizontal bench plate 1 so that they may be separated relatively or moved toward each other in accordance with the width of the sheets to be fed. Each feed rail 3 and 4 includes a plurality of fluid pressure blower jets which are generated through air valves 20 and produced at the level of the surface of the horizontal bench plate 1. A separator, such as a rotatable suction roll 8, is disposed at the level of the surface of the bench plate 1 at an end thereof and is operable to remove each bottom sheet in succession. A feature of the invention is that the rails engage substantially air-tight on the bench plate and there is a groove or notch 39 extending along each side of the rails 3 and 4 on the surfaces which face each other and at the lower level of the blower jets and that this enlargement extends substantially along the length of the sheets being handled.

As seen best from FIG. 1, the sheet feed bench shown in the drawing comprises a rectangular, horizontal bench plate 1 on which there are two sheet feed rails 3 and 4 running parallel to one another and adjustable perpendicular to one another. These sheet feed rails 3, 4 are fastened to the bench plate 1 by screws, not shown, and by means of adjustable clamp devices to a cross-rail 5 which, in turn, is fastened to the bench plate 1 by vertical brackets 6 and 7 at the ends. A suction roll 8 is mounted to rotate in a recess in the front section of the bench plate below the cross-rail 5 and parallel to it. This suction roll 8 is designed in a known manner as a hollow cylinder and has a number of radial suction holes 9 arranged in rows. Inside the suction roll 8 is a vacuum chamber of sector-like design, not shown in the drawings, that is connected to a suction pump. The suction roll 8 is arranged so that the top surface of the bench plate 1 is at least approximately tangential to the circumferential surface of the suction roll 8. There is a vertical stopper plate 10 above the suction roll 8 whose bottom stopping edge 11 is separated from the circumference of the suction roll 8 by approximately the thickness of the sheets to be singled. Means of transport that consist of several transport rolls 13 fastened to a shaft 12 and two pressure rolls 14, that are mounted to rotate in bearing blocks 15 and 16, are located with a small separation from the suction roll 8 in the direction of transport. It is the purpose of these means of transport to transport further each of the bottom sheets taken individually from the stack by the suction roll 8.

The two sheet feed rails 3 and 4 resting on the bench plate 8 are arranged and designed as mirror images of one another. As seen from FIG. 2, each of them includes a rectangular pipe 17 whose cavity 18 is tightly sealed at the front and rear ends. There are compressed air valves 20 that can be sealed off individually arranged in the bottom wall 19 of the rectangular pipe 17 over the entire length, distributed at regular intervals, which can be smaller in the front section than in the other sections of the sheet feed rails. Each of these compressed air valves 20 includes a valve seat sleeve 21 and a closing plate 22 that is fastened by means of a shaft 23 to an adjusting knob 24. In the closed position shown in FIG. 2, the closing plate 22 is pressed against the valve seat sleeve 21 by means of a compression spring 25 encircling the shaft 23. The compressed air valve 20 is .thus closed. The adjusting knob 24 has a washer 26 with two lifters 27 diametrically opposite one another, which can drop into corresponding recesses 28 in a collar 29 when the compressed air valve 20 in question is to be closed. To open the compressed air valve 20, the adjusting knob is turned relative to the collar 29 so that the two lifters 27 come to lie on the upper face 30 of the collar 29 and the closing plate 22 is lifted from the valve seat sleeve 21.

There is a connecting nipple 32 for a compressed air line in the outer wall 31 of the rectangular pipe 17, through which compressed air from a source of compressed air, not shown, can be forced into the cavity 18. The bottom face 33 of the rectangular pipe 17 is provided with a sealing strip 34 cemented on and consisting of flexible material such as foamed rubber, which has tunnel-shaped cutouts 35 (see FIG. 7) at each point where there is a compressed air valve 20. This sealing strip 34 has at least approximately the width of the rectangular pipe 17 and extends over its entire length, and it serves the purpose of producing an air-tight seat between the bench plate 1 and the sheet feed rail 3 or 4, which prevents the undesirable escape of compressed air.

Figure 3:
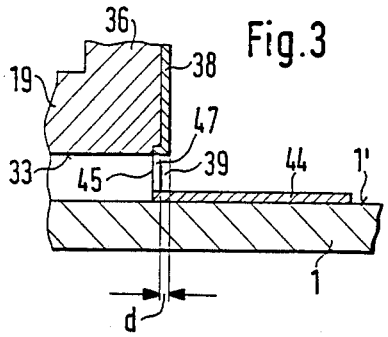
FIG. 3 is an enlarged detailed view of a portion shown in FIG. 2 in the vicinity designated III in dot and dash lines.
Figure 5:
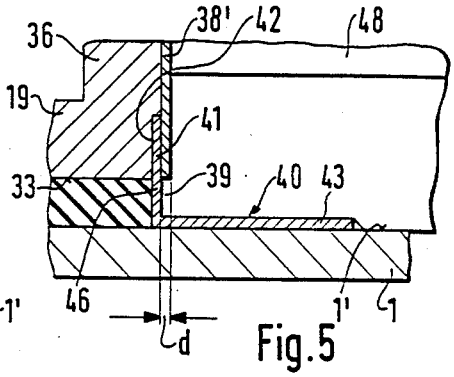
FIG. 5 is a sectional view of the detail III from FIG. 2 between two blower jets.
Figure 4:
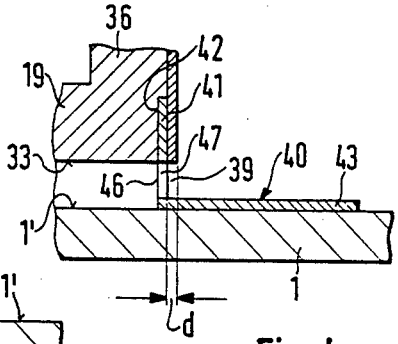
FIG. 4 is a structurally different form of embodiment of the detail III from FIG. 2.
Figure 6:
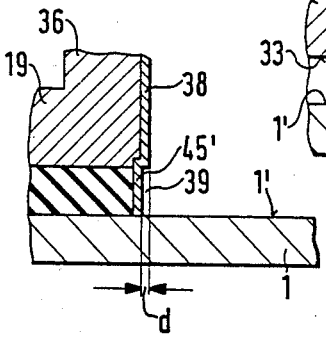
FIG. 6 is another embodiment of the detail III from FIG. 2.

The inner wall 36 of the rectangular pipe is provided with a guide wall 37 lengthened upward, whose height corresponds approximately to three times the height of the rectangular pipe 17. The entire inner surface of the inner wall 36 and of the guide wall 37 following it upward is lined with a smooth, flat sheet metal panel 38 that constitutes a continuous, flat guide surface or alignment surface exactly perpendicular to the bench plate 1 down to the level of the bottom surface 33 of the rectangular pipe 17, for the stack of sheets 53 (FIGS. 8 and 9) resting between the two feeder rails 3 and 4. Below the bottom surface 33 there is a groove-like or notch-like enlargement 39. This groove-like or notch-like enlargement 39 can be formed either by displacing outward the sheet metal panel 38, as shown in FIGS. 3 and 6, in the area between the bottom surface 33 of the rectangular pipe 17 and the upper surface 1' of the bench plate 1, by approximately the thickness d of the sheet metal panel behind, for example 0.5 mm, or by placing an angle wing 40 behind a sheet metal panel 38' ending at the height of the bottom surface 33 of the rectangular pipe 17, whose vertical wing 41 lies in a notch 42 in the wall 36 of the rectangular pipe 17 conforming to its thickness and height, and whose horizontal wing 43 rests on the surface 1' of the bench plate 1, as shown in FIGS. 4 and 5. As seen in FIG. 3, the sheet metal panel 38 also has an integrally attached wing 44 bent away horizontally. The horizontal wing 43 and 44 each extend into the stack space bounded on the sides by the two feeder rails 3 and 4. Because of the fact that the wing 43 is connected integrally to the wing 41 of the angle rail 40, and the horizontal wing 44 is connected integrally to the sheet metal panel 38, it is assured that no open gap can be present between the surface 1' of the bench plate 1 and the wall section 45 or 46 defining the enlargement 39 on the side, in which a sheet from the stack might become stuck. In FIG. 6, the bottom face of the wall section 45 forming the enlargement 39 rests directly on the surface 1' of the bench plate 1 without being provided with a horizontal wing 44. The aforementioned risk that slit-like intermediate spaces may be formed from irregularities in the bench surface 1', in which the side edges of a sheet can catch, is not precluded.

Another advantage of these horizontal wings consists of the fact that because they do not rest air-tight on the bench surface 1', blown air is fed below them beneath the bottom sheet of the stack of sheets 53, and forms the desired air cushion there.

As seen in FIGS. 3 and 4, channels 47 are provided in the wall sections 45 and 46 that define the groove-like enlargements 39, that constitute the blowing jets, with each of them separately being connected to one of the compressed air valves 20 through the cutouts 35 in the sealing strip 34. It is also beneficial here for the longitudinal edge section 35' of the sealing strip between the individual cutouts 35 to rest as tightly as possible against the wall sections 45 or 46.

The channels 47 have an essentially rectangular shape with a height of approximately 2 mm and a length of 8–10 mm. The enlargements 39, that are present as mirror images of one another in the two sheet feeder rails 3 and 4 in the same way make it possible to adjust the two sheet feeder rails 3 and 4 to the width of the stacked sheets between them so that there are no spaces between the inner surfaces of the sheet metal panels 38 and the long sides of the stack of sheets through which the compressed air supplied by the blower jets 47 can escape upward, but that the bottom sheets of the stack have enough lateral clearance at the level of the enlargements 39 to be pulled away by the suction roll 8 with no hindrance. By preventing the escape of the blown air along the inner surfaces of the sheet metal panels 38, at least to a great extent, a substantially more effective formation of an air cushion occurs in the bottom area of the stack of sheets, i.e., between the bench plate and the sheet or sheets of the stack 53 lying in the area of the enlargement 39, that can withstand a substantially higher stack weight than was possible with the conventional systems for the formation of air cushions.

For the sealing strips 34 to rest air-tight on the surface 1' of the bench plate, and so that the compressed air supplied to the individual channels 47 constituting the blowing jets through the compressed air valves 20 and the cutouts 35 in the sealing strips 34 forming the connecting channels cannot escape between the sheet feeder rails 3 and 4 and the bench plate 1, there are screw connections, not shown, by which the sheet feeder rails 3 and 4 and their sealing strips 35 can be pressed firmly against the bench plate 1, but which can be loosened for shifting the sheet fender rails 3 and 4 sidewards.

Although such a great improvement of the formation of the air cushion is achieved by air-tight contact of the sheet feeder rails 3 and 4 on the bench plate 1, on the one hand, and by the enlargement 39 provided in the area of the blowing jets 47, or by the contact of the guide walls 37 against the long edges of the stack of sheets with no clearance made possible by this, that stack heights can be used that are two to three times as large as with the conventional systems without impairing the sheet singling, an additional improvement of the formation of the air cushion in the area of the bottom sheet or sheets of the stack can be produced by also sealing off the rear transverse edge of the stack of sheets 53 in the area of its bottom sheets. For this purpose, a sealing ledge 48 of relatively soft rubber (for example, 35° Shore hardness) or a rubberlike material, extending from inner surface to inner surface of the sheet feeder rails 3 and 4 is provided, that has a shallow, strip-like cross section with two groove-like cavities 49 and 50 open at the bottom and continuous in the longitudinal direction. One of these groove-like cavities 50 is provided with an elbow-shaped connecting port 51 by which it can be connected to a suction pump through a hose 52. The sealing ledge 48 is pressed air-tight against the surface of the bench plate 1 by means of the vacuum formed in the cavity 50. This provides the possibility of arranging the sealing ledge either as in FIG. 8 directly behind the stack of sheets 53, or as in FIG. 9, so that the rear end of the stack of sheets 53 rests on the sealing ledge 48 by approximately 1 to 2 cm. Whether the arrangement of FIG. 8 or of FIG. 9 is chosen depends essentially on the paper quality. With very thin and flexible paper, it is beneficial to use the arrangement as shown in FIG. 8. With relatively thick and stiff paper, the arrangement of FIG. 9 can also be chosen. In both cases, the escape of compressed air at the rear edge of the stack of sheets can be so greatly reduced by the sealing ledge 48, which must agree in length to the distance between the two sheet feeder rails 3 and 4, that the formation of the air cushion improved by it permits another increase of the height or weight of the stack of sheets, and that nevertheless the paper singling can take place without errors down to the last sheet, both with a large stack height and with the smallest stack height.

It is to be understood that sealing ledges 48 of different lengths are also necessary for sheet stacks 53 of different widths. The lengths of the sealing ledges should be approximately 3 to 5 mm greater than the separation of the two sheet feeder rails 3 and 4 in agreement with the stack width in each case, so that the ends of the sealing ledge 48 can also lie as directly as possible against the insides of the sheet feeder rails 3, 4, or in their enlargements 39.

While specific embodiments of the invention have been shown and described in detail to illustrate the application of the principles of the invention, it will be understood that the invention may be embodied otherwise without departing from such principles.

What is claimed is:

1. A sheet feed bench comprising a horizontal bench plate, first and second parallel sheet feed rails on said bench plate at least one of which is adjustably movable toward and away from the other, a plurality of fluid pressure blower jets carried by each feed rail and located directly above the level of said bench plate on the sides of said rails facing one another, said bench plate being adapted to be supplied with sheets to form a stack which is refillable from the top of the stack, single sheet separator means located adjacent said bench plate operable to remove the bottom sheet from a stack of sheets, each of said feed rails resting substantially airtight on the surface of said bench plate and having a groove defining respective enlargements on the surface of said rails which face one another at the level of said blower jets and which extend substantially over entire length of the each rail.

2. A sheet feed bench according to claim 1, including a sealing ledge resting on the surface of said bench plate extending between the facing surfaces of said rails.

3. A sheet feeder according to claim 2, wherein said sealing ledge has the cross-sectional shape of a shallow rectangle with at least one groove forming a cavity open on its bottom and continuous in a longitudinal direction which it can be connected to a suction pump.

4. A sheet feed bench according to claim 1, wherein said feed rails each include a rectangular pipe member, a flexible sealing strip made of rubber composition disposed between a bottom portion of said rectangular pipe and said bench plate.

5. A sheet feed bench according to claim 4, further comprising a channel located in the area of said sealing strip formed in a wall extending through said rail toward said bench plate and projecting below the bottom surface of said sheet feed rails and entering into the portion of said rails forming said enlargement, said sealing strip having cut-outs behind individual channels, each blower jet having a compressed air valve located in the bottom portion of said pipe of said feed rails.

6. A sheet feed bench according to claim 5, wherein each channel forming said blower jet has an elongated shape with a height of from 1 to 3 mm and a length of from 8 to 10 mm.

7. A sheet feed according to claim 6, wherein said pipe has wall sections containing said blower jets with a thin-walled angle wing attached integrally that rests flat and projects inwardly on the surface of said bench plate.

8. A sheet feeder according to claim 4, wherein each of said feed rails has a vertical guide wall, said rectangular pipe portion being positioned at a lower end of the guide walls, each of the guide walls having at least twice the height of said rectangular pipe portion, said feed rail guide walls having inner surfaces facing one another covered with a smooth flat sheet metal panel.

9. A sheet bench according to claim 8, wherein said wall section containing said blower jets is part of an angle rail having a vertical wing with a notch in said sheet rail conforming to the thickness thereof having a horizontal wing resting against the surface of said bench plate, said sheet panel having a bottom edge forming the upper edge of the said enlargement.

10. A sheet feeder according to claim 9, wherein said enlargement conforms to the thickness of said sheet metal panel of approximately 0.5 mm.

11. A sheet feeder according to claim 8, wherein said pipe section containing said blower jets having a horizontal angle wing attached integrally to said sheet metal panel.

12. A method of separating sheets from a stack of sheets which are positioned on a bench plate and which comprises the steps of arranging guide rails on each side of the stack of sheets which may be moved inwardly to engage each respective side, maintaining the bottoms of the guide rails in substantially air-tight connection with said bench plate, providing an enlargement in each guide rail extending along substantially the length of the sheets at the level of the bench plate and directing a fluid jet through the enlargement toward the sheets while the lowermost ones of the sheet are being removed from the stack of sheets.

13. A sheet feed bench comprising a horizontal bench plate, first and second parallel sheet feed rails on said bench plate at least one of which is adjustably movable toward and away from the other, a plurality of fluid pressure blower jets carried by each feed rail and located directly above the level of said bench plate on the sides of said rails facing one another, said bench plate being adapted to be supplied with sheets to form a stack which is refillable from the top of the stack, single sheet separator means located adjacent said bench plate operable to remove the bottom sheet from a stack of sheets, each of said feed rails resting substantially airtight on the surface of said bench plate and having a groove defining respective enlargements on the surface of said rails which face one another at the level of said blower jets and which extend substantially over the entire length of each rail, including a sealing ledge resting on the surface of said bench plate extending between the facing surfaces of said rails.

* * * * *